United States Patent [19]

Müller

[11] Patent Number: 4,511,132

[45] Date of Patent: Apr. 16, 1985

[54] GATHERING MACHINE FOR PAPER SHEETS OR THE LIKE

[75] Inventor: Hans Müller, Zofingen, Switzerland

[73] Assignee: Grapha-Holding AG, Hergiswil, Switzerland

[21] Appl. No.: 94,321

[22] Filed: Nov. 14, 1979

[30] Foreign Application Priority Data

Nov. 17, 1978 [CH] Switzerland ..... 11823/78

[51] Int. Cl.[3] ..... B65H 39/02

[52] U.S. Cl. ..... 270/58

[58] Field of Search ..... 270/54, 58

[56] References Cited

U.S. PATENT DOCUMENTS

| | | | |
|---|---|---|---|
| 2,702,189 | 2/1955 | Zugel | 270/58 |
| 3,311,368 | 3/1967 | Sarring | 270/54 |
| 3,414,257 | 12/1968 | Muller | 270/58 |
| 3,717,337 | 2/1973 | McCain | 270/54 |
| 4,056,264 | 11/1977 | Dhooge | 271/211 |

FOREIGN PATENT DOCUMENTS

| | | | |
|---|---|---|---|
| 376940 | 6/1964 | Switzerland | 270/58 |

*Primary Examiner*—Clifford D. Crowder
*Attorney, Agent, or Firm*—Peter K. Kontler

[57] ABSTRACT

A gathering machine wherein a chain conveyor has pushers which advance below a row of platforms receiving sheets from discrete magazines. An orbiting arm in the region of each platform carries an elastic cap which engages a freshly delivered sheet to press it against the upper side of the respective platform and to accelerate such sheet in the direction of movement of the pushers so that the speed of sheets approximates or equals the speed of pushers not later than when the pushers engage and entrain accelerated sheets. Streams of compressed air are directed against the upper sides of sheets on the platforms by nozzles receiving compressed air through a valve which is closed while the platforms receive fresh sheets. The sheets which are removed from the platforms descend onto a stationary rail to form growing stacks, and such stacks are advanced by the pushers beyond the foremost platform where the fully grown stacks are removed or subjected to further treatment.

13 Claims, 4 Drawing Figures

GATHERING MACHINE FOR PAPER SHEETS OR THE LIKE

BACKGROUND OF THE INVENTION

The present invention relates to gathering machines for use in bookbinding and analogous plants wherein discrete (folded or unfolded) sheets or groups of sheets (e.g., signatures) are assembled to form stacks of dissimilar sheets or dissimilar groups of sheets. More particularly, the invention relates to gathering machines of the type wherein a conveyor transports partly grown stacks of sheets past several magazines for piles of identical sheets and wherein the sheets which are withdrawn from successive magazines are stacked on top of each other. Still more particularly, the invention relates to gathering machines of the type wherein sheets which are withdrawn from magazines are deposited on platforms or analogous supports prior to stacking of such sheets on top of each other to constitute brochures, pamphlets, books, newspapers or analogous commodities. As a rule, the sheets which descend onto or are otherwise deposited on the platforms are removed by pushers or analogous entraining elements of the conveyor which is driven to advance the pushers along a horizontal path below the platforms.

A drawback of the just described gathering machines is that the pushers effect an abrupt removal of sheets from the respective platforms. This can result in pronounced deformation of and/or other damage to sheets, especially if the sheets are readily flexible and/or if the gathering machine is intended or designed to accumulate a large number of stacks of dissimilar sheets or dissimilar groups of sheets per unit of time. In fact, abrupt acceleration of sheets (especially discrete sheets) from zero speed to the full speed of pushers is even likely to entail deformation of and/or other damage to relatively stiff sheets. Excessive deformation, tearing and/or other damage to sheets and/or groups of sheets greatly affects the output of a gathering machine because the machine must be decelerated or arrested without delay at frequent intervals in order to allow for removal of defective sheets, groups of sheets and/or partly grown or fully grown stacks without risking injury to attendants and/or damage to component parts of the machine. Therefore, the maximum output of the just described gathering machines is relatively low because the speed of the pushers cannot exceed a rather low value in order to reduce the likelihood of deformation of sheets during transfer from the respective platforms.

Swiss Pat. No. 425,721 a modified gathering machine wherein the platforms are movable in and counter to the direction of advancement of pushers so as to accelerate the freshly deposited sheets during forward movement and prior to entrainment of such sheets by the oncoming pushers. The patent proposes to accelerate the sheets at least close to the speed of the oncoming pushers prior to stripping of such sheets off the corresponding platforms. The patented machine is less likely to damage the sheets; however, the platforms must be reciprocated at a high frequency and their mass is relatively high so that the machine which embodies such structure must employ a bulky and sturdy frame which is securely anchored to the floor. The wear upon the platforms, and especially upon the means for reciprocating the platforms, is very pronounced, particularly if the patented machine is to turn out a large number of fully grown stacks per unit of time.

OBJECTS AND SUMMARY OF THE INVENTION

An object of the invention is to provide a gathering machine with novel and improved means for accelerating paper sheets or the like prior to deposition onto the partly grown stacks.

Another object of the invention is to provide a gathering machine whose output greatly exceeds or can greatly exceed the output of conventional machines without causing deformation of and/or other damage to sheets.

A further object of the invention is to provide a gathering machine wherein the platforms for sheets or groups of sheets need not be reciprocated so that the machine can embody a lightweight frame and a relatively simple anchoring system for connection of the frame to the floor in a bookbinding or similar plant.

An additional object of the invention is to provide the gathering machine with novel and improved means for initiating and assisting the removal of discrete sheets or groups of sheets from one or more platforms or analogous supports.

Another object of the invention is to provide novel and improved means for properly orienting and/or for maintaining proper orientation of sheets on the platforms of a gathering machine.

A further object of the invention is to provide novel and improved means for facilitating the conversion of a gathering machine of the above outlined character from accumulation of relatively small stacks of discrete sheets or groups of sheets to accumulation of larger stacks or vice versa.

An additional object of the invention is to provide the gathering machine with novel and improved means for rapidly accumulating stacks of desired height in a fully automatic way and at a rate which cannot be matched in presently known gathering machines with stationary or reciprocable platforms.

One feature of the invention resides in the provision of a machine for gathering discrete sheets or groups of sheets into stacks or analogous accumulations. The machine comprises a conveyor having a plurality of spaced-apart entraining means (e.g., pushers which extend outwardly from a chain conveyor) which move in a predetermined direction and along a predetermined path (e.g., along a substantially horizontal path), a plurality of spaced-apart supports (e.g., in the form of horizontal or inclined platforms or tables) which are adjacent to the path and are disposed one after the other, as considered in the direction of movement of the entraining means, transfer means which serve to deposit sheets onto the supports so that the deposited sheets extend into the aforementioned path (i.e., that the deposited sheets can be advanced by the oncoming entraining means), a plurality of mobile hold-down devices for sheets, at least one for each support, for urging the deposited sheets against the respective supports, and means for moving the hold-down devices into engagement with sheets on the respective supports in synchronism with movements of the entraining means so that a sheet which is engaged by the oncoming entraining means is urged against the respective support by the associated hold-down device.

Another feature of the invention resides in the provision of a plurality of mobile sheet advancing or accelerating devices, at least one for each of the supports, and means for moving the advancing devices in synchronism with movements of the entraining means so as to accelerate the sheets on the respective supports in the aforementioned direction and at least approximately to the speed of the entraining means before the sheets on the supports are engaged and advanced by the oncoming entraining means.

In accordance with a further feature of the invention, the hold-down devices can constitute or form part of the respective advancing devices, or the advancing devices can constitute or form part of the respective hold-down devices. Each such device can comprise an orbiting member which preferably consists of elastomeric material and frictionally engages a sheet on the respective support to thereby urge the sheet against the support as well as to accelerate the sheet in aforementioned direction during a certain stage of its revolution and at a time when the sheet is about to be or is in the process of being engaged by the oncoming entraining means.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
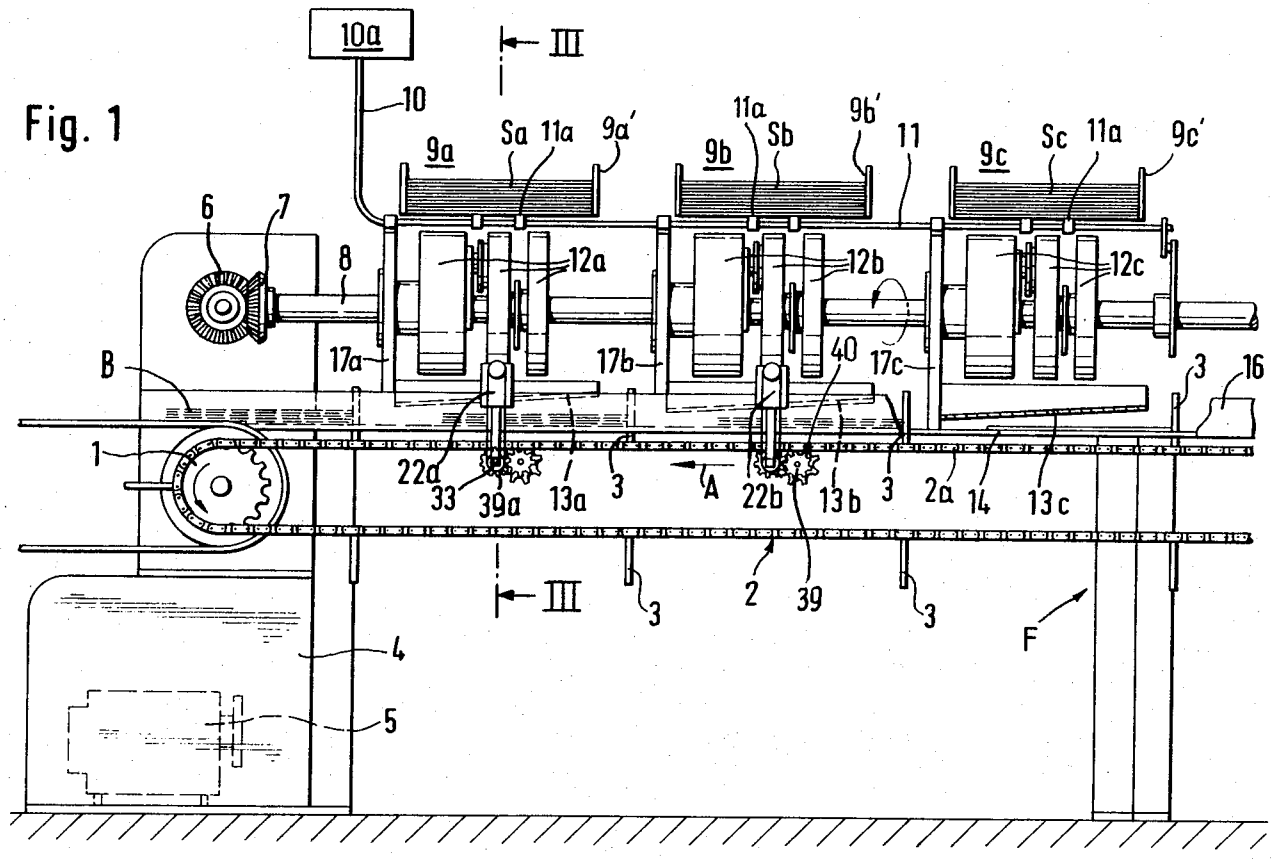
FIG. 1 is a somewhat schematic front elevational view of a gathering machine which embodies one form of the present invention.

FIG. 1 shows a gathering machine which comprises a conveyor including an endless chain 2 which is trained over sprocket wheels 1 and is driven to move its upper reach 2*a* in the direction indicated by the arrow A. The chain 2 carries outwardly extending entraining elements in the form of equidistant pushers 3. That (front) sprocket wheel 1 which is shown in FIG. 1 is driven by a prime mover 5 (e.g., a variable-speed electric motor) which is installed in a casing 4 adjacent to the lower part of the frame F of the gathering machine. The prime mover 5 further drives a bevel gear 6 which transmits torque to a second bevel gear 7 mounted on a horizontal drive shaft 8 which is disposed at a level above and is substantially parallel with the upper reach 2*a* of the chain 2. The shaft 8 transmits torque to a series of transfer units 12*a*, 12*b*, 12*c* forming part of devices 9*a*, 9*b*, 9*c* for delivering sheets to a stacking device 14 in the form of a substantially horizontal rail which is disposed at a level slightly above the upper reach 2*a* of the chain 2 and has a longitudinally extending slot 15 (see FIG. 3) for the pushers 3.

Each of the delivering devices 9*a* to 9*c* comprises a magazine 9*a*', 9*b*', 9*c*' for a pile Sa, Sb, Sc of discrete identical sheets S (FIGS. 2 and 3) which may but need not be folded. Also, each such sheet may form part of a complete signature. In other words, the piles Sa–Sc may contain discrete sheets, folded-over sheets or signatures. For the sake of simplicity, the contents of the piles Sa–Sc will be referred to as sheets. The magazines 9*a*' to 9*c*' are mounted in the frame F and are designed in such a way that they permit withdrawal of successive lowermost sheets S of the corresponding piles Sa–Sc for delivery to the associated transfer units 12*a*, 12*b*, 12*c*. The gathering machine further comprises means for withdrawing sheets S from the magazines 9*a*' to 9*c*' and for delivering the thus withdrawn sheets S into the range of the continuously driven transfer units 12*a*–12*c*. The withdrawing means comprises an elongated suction pipe 11 which is parallel to and is disposed above the shaft 8. One end (namely, the left-hand end, as viewed in FIG. 1) of the suction pipe 11 is connected with a second pipe 10 which establishes communication between the pipe 11 and a suction generating device 10*a* (e.g., a suction fan) in such a way that the pipe 11 can turn about its own axis. The pipe 11 carries pairs of suction heads 11*a* (see particularly FIG. 3) which pivot back and forth to withdraw successive lowermost sheets S from the corresponding piles Sa–Sc and to deliver the withdrawn sheets into the range of the corresponding transfer units 12*a*–12*c*.

Each of the transfer units 12*a*–12*c* comprises rotary elements or discs which are mounted on the shaft 8 and are provided with grippers (not specifically shown) serving to engage the sheets S delivered by the corresponding pairs of suction heads 11*a* and to deposit such sheets on associated platforms or supports 13*a*, 13*b* 13*c* which are mounted in the frame F at a level slightly above the rail 14. FIG. 1 shows that each platform slopes forwardly and downwardly, as considered in the direction which is indicated by the arrow A. The manner in which the grippers of the discs in the transfer units 12*a*–12*c* open at the time they receive sheets S from the associated pairs of suction heads 11*a* and thereupon close to advance the sheets onto the corresponding platforms 13*a*–13*c* is well known in the art of gathering machines; therefore, the mechanisms for opening and closing the grippers are not specifically shown in the drawing.

The rail 14 includes two mutually inclined sections 14*a*, 14*b* which are separated from each other by the aforementioned gap 15 for the pushers 3. The platforms 13*a*–13*c* are located at a level above the laterally inclined section 14*a* of the platform 14. A sheet S which descends onto the platform 13*a*, 13*b* or 13*c* extends beyond such platform to overlie but to remain spaced apart from the horizontal section 14*b* of the rail 14, i.e., such sheet extends into the path of forward movement of the pushers 3. The length of the pushers 3 suffices to ensure that they can remove discrete sheets S from the platforms 13*a*–13*c* and to cause the thus removed sheets S to descend onto the rail 14.

Each stage of operation of the gathering machine involves the delivery of a sheet S to each of the platforms 13*a*–13*c*. The oncoming pushers 3 thereupon remove the sheets S from the platforms 13*a*–13*c* and cause the sheets to descend onto the rail 14 whereon the sheets S form growing stacks P. Fully grown stacks B which advance beyond the foremost platform 13*a* are ready to be introduced into a stapling, binding or other connecting machine of any known design. Each such stack B contains or can contain all sheets of a pamphlet, brochure, booklet, book or the like.

Figure 2:
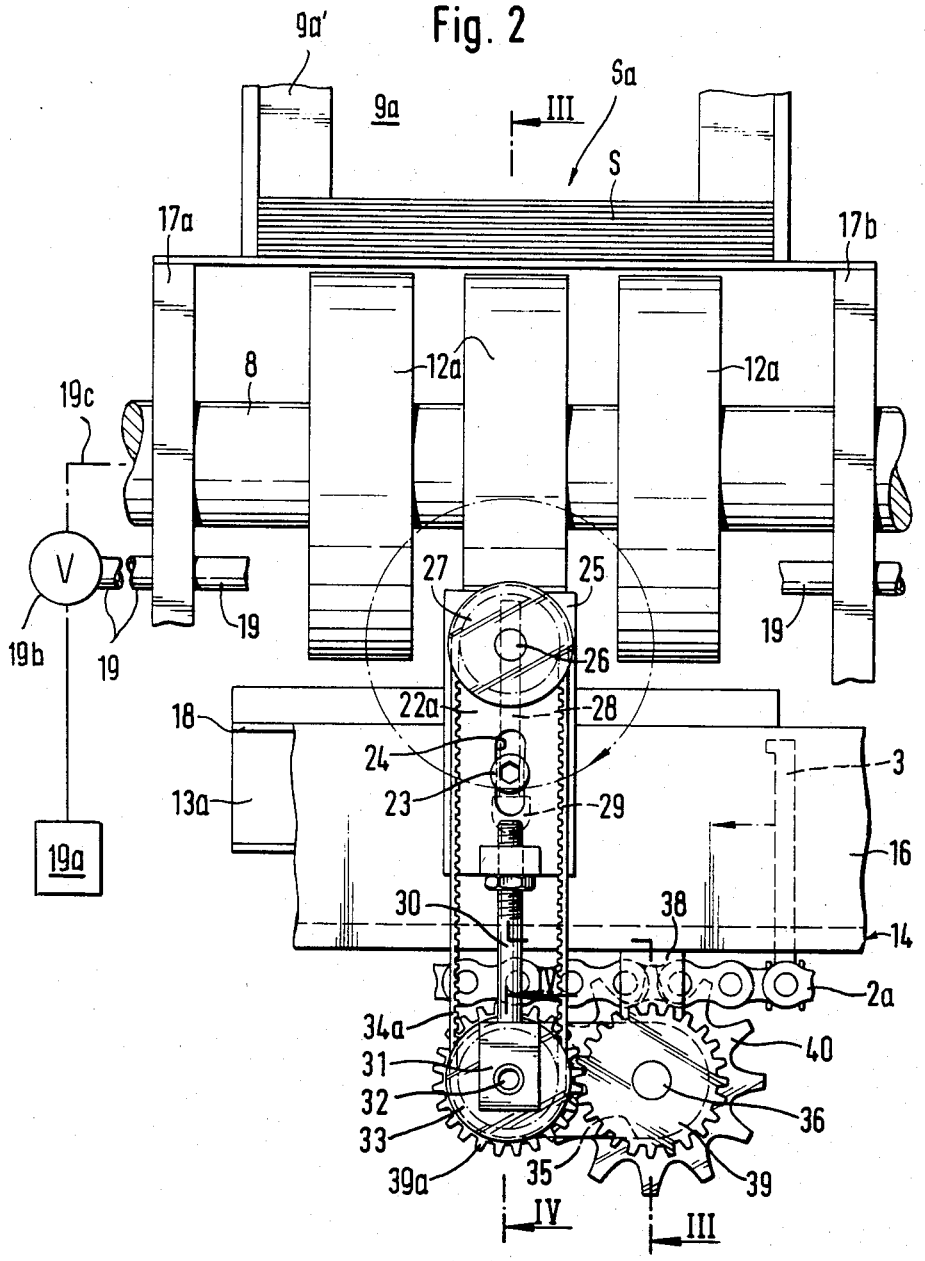
FIG. 2 is an enlarged view of a detail in the gathering machine of FIG. 1, showing the foremost support and the associated means for transferring sheets onto and off such support.
Figures 3, 4:
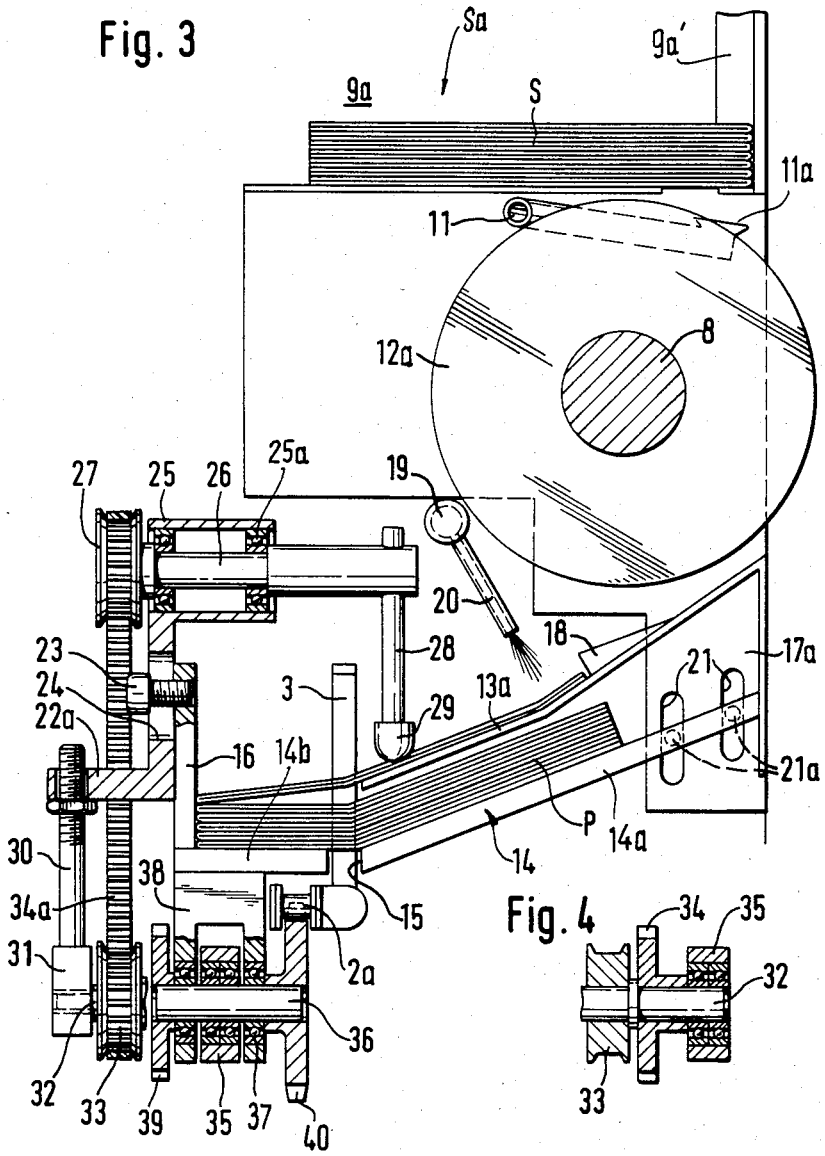
FIG. 3 is a transverse vertical sectional view as seen in the direction of arrows from the line III—III of FIG. 1 or 2.
FIG. 4 is a fragmentary sectional view as seen in the direction of arrows from the line IV—IV of FIG. 2.

As shown in FIGS. 1 to 3, the platforms 13a–13c are respectively mounted on plate-like bearing members 17a, 17b, 17c for the shaft 8. The bearing members 17a–17c are adjustably mounted on the frame F. The upper sides of the platforms 13a–13c have projections 18 which cooperate with an upwardly extending flange 16 of the rail section 14b to guide the sheets S during transport along the respective platforms in the direction of arrow A. The flange 16 may constitute a discrete component in or on the frame F. Also, the flange 16 can be interrupted, i.e., it need not be as long as the rail 14. All that counts is to ensure that the flange 16 can cooperate with the projections 18 to guide the sheets S along two opposite edges during transport along the platforms 13a–13c.

The frame F supports a conduit 19 which is parallel to the shaft 8 and has nozzles 20 (see FIG. 3) which can discharge streams or jets of compressed air or another gaseous fluid against the upper sides of sheets S on the platforms 13a–13c. The plenum chamber or another source which supplies compressed fluid to the conduit 19 is shown at 19a. The reference character 19b denotes a valve which controls the flow of fluid from the source 19a into the conduit 19, i.e., into the nozzles 20. At least one nozzle 20 is located above each platform (13a–13c), and the nozzles 20 are installed or oriented in such a way that, when the valve 19b is open, their orifices discharge jets of compressed air in regions close to the respective projections 18. The valve 19b seals the source 19a from the nozzles 20 during transfer of sheets S from the piles Sa–Sc onto the respective platforms 13a–13c, and the valve 19b opens when the sheets on the platforms abut against the flange 16. The means for actuating the valve 19b is denoted by a phantom line 19c. Such actuating means can derive motion from the shaft 8 to actuate the valve 19b in synchronism with angular movements of rotary elements of the transfer units 12a–12c. Alternatively, the valve 19b can be actuated by a camshaft which is driven by the prime mover 5 in synchronism with the shaft 8, or by a proximity detector switch which transmits signals in response to activation by one or more magnets or like components on the shaft 8.

The bearing members 17a–17c have pairs of vertical slots 21 for fasteners in the form of screws 21a which adjustably secure the members 17a–17c to the frame F. This enables an attendant to vary the level of the platforms 13a–13c with reference to the rail 14. The shaft 8 shares the movements of bearing members 17a–17c and platforms 13a–13c relative to the frame F and rail 14. It goes without saying that the bevel gears 6, 7 are replaced with a different set of bevel gears if the shaft 8 is moved up or down. The just discussed adjustments of the platforms 13a–13c are necessary when the gathering machine is to be converted from the assembly of relatively thin brochures, books or the like to the assembly of relatively thick books or vice versa.

The frame F further supports discrete carriers or brackets 22a, 22b, 22c (the bracket 22c is not shown), one for each of the platforms 13a–13c. The brackets 22a–22c are separably and adjustably affixed to the flange 16 by screws 23 whose shanks extend through vertical or nearly vertical slots 24 of the respective brackets. The upper portions of brackets 22a–22c carry sleeves 25 for antifriction bearings 25a on horizontal shafts 26 which extend at right angles to the drive shaft 8. The outer end portions of the shafts 26 are connected with pulleys 27 for toothed belts 34. The inner end portions of the shafts 26 carry radially extending combined hold-down and advancing or accelerating arms 28 whose free ends are confined in caps 29 consisting of rubber or other suitable elastomeric material. The elastomeric material of the caps 29 is preferably selected (or its external surface is processed) in such a way that it can engage the exposed upper side of a sheet S on the adjacent platform 13a, 13b or 13c with a pronounced friction. When the shafts 26 are driven by the corresponding pulleys 27, the arms 28 orbit about horizontal axes and their caps 29 engage the sheets S on the neighboring platforms 13a–13c to press the sheets against the platforms as well as to accelerate the sheets in the direction of arrow A, preferably to the exact speed of forward movement of the upper reach 2a and its pushers 3. The interval of engagement of each cap 29 with a sheet S during a certain stage of each revolution of the corresponding shaft 26 is relatively short. By adjusting the levels of the brackets 22a–22c, one can readily select the positions of the shafts 26 in such a way that the tips of the caps 29 orbit along circular paths to which the sheets S on the respective platforms 13a–13c and the upper sides or surfaces of such platforms are substantially tangential. Thus, the pressure which the caps 29 apply against the sheets S to urge the sheets against the upper sides of the corresponding platforms 13a–13c is rather slight; however, it suffices to insure that the sheets are properly accelerated in the direction of arrow A to avoid deformation of the sheets by the oncoming pushers 3, especially since the frictional engagement between each cap 29 and the sheet S therebelow is quite pronounced.

The brackets 22a–22c further support downwardly extending holders in the form of upright posts 30. The posts 30 are adjustably affixed to the corresponding brackets 22a–22c, and their lower end portions are provided with or comprise horizontal bearings 31 for shafts 32 which carry pulleys 33 for the respective toothed belts 34. The inner end portions of the shafts 32 are indirectly connected with sprocket wheels 40 which derive motion from the upper reach 2a of the chain 2. More specifically, the inner end portions of the shafts 32 are freely rotatable in levers 35 which are pivotable about the axes of horizontal shafts 36. The shafts 36 are rotatable in bearings 37 mounted in metallic plates 38 secured to the section 14b of the rail 14. Each shaft 36 is driven by a discrete sprocket wheel 40 and transmits torque to the associated shaft 32 by way of a gear train 39, 39a. Thus, the chain 2 drives the pulleys 27 and the corresponding arms 28 via toothed belts 34, shafts 32, gear trains 39, 39a, shafts 36 and sprocket wheels 40.

By moving the brackets 22a–22c up or down (upon loosening of the corresponding screws 23), the shafts 32 are moved along arcuate paths about the axes of the respective shafts 36 without disengaging the gears 39a from the associated gears 39. This ensures that the arms 28 are driven by the chain 2 in each and every position of adjustment of such arms, i.e., regardless of the height or thickness of the finished stacks B.

Each cap 29 has a component of movement in the direction of arrow A when it is located close to the respective platform 13a, 13b or 13c.

The operation of the gathering machine is as follows:

Each pair of suction heads 11a delivers a fresh sheet S from the corresponding magazine 9a'–9c' into the range of grippers on the transfer units 12a–12c, and each transfer unit delivers a sheet onto the corresponding platform 13a–13c during each revolution of the drive shaft 8. The valve 19b is sealed during transfer of sheets S onto the platforms 13a–13c, and the caps 29 are remote from the platforms (they can be located at the apices of the respective circular paths) to ensure that they cannot interfere with the deposition of fresh sheets S onto the corresponding platforms). At the same time, the oncoming pushers 3 advance partially grown or assembled stacks P along the rail 14 and on toward the stations where the height of the stacks P increases as a result of addition of sheets S which are moved beyond the platforms 13a–13c. More specifically, and if the gathering apparatus comprises only three magazines 9a'–9c', the pusher 3 which approaches the platform 13c does not push any sheets S, the pusher 3 which approaches the platform 13b advances a single sheet, the pusher which approaches the platform 13a advances two superimposed different sheets, and the pusher which advances beyond the platform 13a pushes a fully grown stack B of three different superimposed sheets.

The movements of various components of the gathering machine are preferably synchronized in such a way that the leader of a sheet S which is advanced by a pusher 3 approaching the platform 13b is already below the platform 13b when the cap 29 above the platform 13b begins to advance the sheet S on this platform toward the platform 13a. This ensures that the leader of the sheet S which is in the process of being stripped off the platform 13b need not descend directly onto the rail 14 but rather onto the oncoming partly grown stack P. The platforms 13a–13c may but need not be shorter (as considered in the direction of arrow A) than the sheets S.

A cap 29 engages and accelerates the sheet S on the corresponding platform 13a, 13b or 13c before the trailing edge of such sheet is engaged and advanced by the oncoming pusher 3. This is advantageous and desirable because the pusher cannot deform and/or otherwise damage the sheet which is about to descend onto the rail 14 or onto a growing stack P. The likelihood of damage to sheets S is especially remote if the speed of orbital movement of caps 29 matches the speed of forward movement of the pushers 3. This can be readily achieved by appropriate selection of the ratio of transmissions which derive motion from the chain 2 and drive the arms 28. As mentioned above, the caps 29 can cause the sheets S therebelow to bear against the upper sides of the respective platforms 13a–13c with a certain force which need not be pronounced but suffices to guarantee satisfactory frictional engagement between the caps 29 and the upper sides of the sheets S which are about to descend onto the rail 14 or onto a partly grown stack P. The likelihood of damage to the sheets S is remote even if the speed of orbital movement of the caps 29 does not match the speed of the pushers 3, as long as the caps 29 are disengaged from the accelerated sheets S before or shortly after the trailing edges of such sheets are engaged by the oncoming pushers. As a rule, the sheets S on the platforms 13a–13c should not be engaged by the oncoming pushers before the sheets are pressed against the respective platforms by the corresponding caps 29. It goes without saying that the preferred timing of engagement between an accelerated sheet S and the oncoming pusher 3 is such that the pusher engages the trailing edge of the respective sheet when the speed of the sheet (as considered in the direction of arrow A) matches or very closely approximates the speed of the chain 2. It will be noted that the arms 28 and their caps 29 carry out a combined hold-down and advancing or accelerated action. If desired, the hold-down or the advancing action can be performed by separate elements; however, the illustrated construction is preferred at this time because it is simple, compact and relatively inexpensive. Moreover, the hold-down action is necessarily synchronized with the advancing or accelerating action. This also contributes to a reduction of the likelihood of deformation of and/or other damage to sheets S during transfer onto the rail 14 or onto the oncoming partially growing stacks P. Any misalignment of freshly descended sheets S and the sheets of partially grown stacks P is eliminated by the pushers 3 before the stacks P are converted into fully grown stacks B.

The movement of caps 29 away from the sheets S which are being advanced by the pushers 3 is gradual so that the caps 29 cannot cause any undesirable changes in the orientation of and/or any damage to such sheets when the arms 28 begin to raise the associated caps above and away from the respective platforms. This is due to the selected speed of arms 28 as well as to appropriate synchronization of movements of these arms with the movements of pushers 3. The just described mode of operation (transfer of sheets onto and off the platforms 13a–13c) is repeated during each revolution of the drive shaft 8. The arms 28 and their caps 29 (and more particularly the combined hold-down and accelerating or advancing action of such components) enable the gathering machine to accumulate a large number of fully grown stacks B per unit of time without causing pronounced wear upon the stationary and/or moving parts and without adversely affecting the appearance and/or condition of the stacks B and/or their sheets S. The absence of pronounced wear is attributable to the fact that the mass of moving parts is relatively small, especially since the platforms 13a–13c need not move back and forth in and counter to the direction of movement of the upper run 2a of the chain 2. Furthermore, the absence of any need for such reciprocating movements of the platforms 13a–13c renders it possible to employ a relatively lightweight frame F and to dispense with strong, bulky and expensive anchors for securing the frame to the floor in a plant for the making or assembling of books, brochures, pamphlets and like commodities.

The purpose of the nozzles 20 is to discharge jets of compressed gaseous fluid against the upper sides of the freshly deposited sheets S on the respective platforms 13a–13c. Such discharge of compressed gaseous fluid is terminated or can be terminated before the sheets are engaged and accelerated by the corresponding caps 29. At any rate, the discharge of compressed gas is or preferably should be terminated before the trailing edges of the sheets S on the platforms 13a–13c are engaged by the oncoming pushers 3. The purpose of the streams or jets issuing from the orifices of the nozzles 20 is to ensure that the inner edges of sheets S lie against the respective projections 18. This further reduces the likelihood of deformation and/or other damage when the sheets on the platforms are engaged by the pushers 3. In addition, the blasts of compressed gas can slightly fold the sheets S in the region of the gap 15 (note the slight V-shape of the sheets S which are shown in FIG. 3) which enhances the resistance of sheets to deformation and increases the likelihood of satisfactory guidance of their lateral edges by the flange 16 and projections 18.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptaions should and are intended to be comprehended within the meaning and range of equivalence of the claims.

I claim:

1. In a machine for gathering sheets into stacks or similar accumulation, the combination of a conveyor having a plurality of spaced-apart entraining means arranged to move in a predetermined direction and along a predetermined path; a plurality of supports adjacent to said path and disposed one after the other, as considered in said direction; transfer means for delivering sheets to said supports so that the delivered sheets extend into said path; a plurality of mobile combined advancing and hold-down devices, one for each of said supports, for urging the delivered sheets against the respective supports; and means for moving said devices into engagement with the sheets on said supports and thereupon at least substantially in said direction in synchronism with movements of said entraining means so that a sheet which is about to be engaged by the oncoming entraining means is urged against the respective support by the associated device and is already accelerated by such device with reference to and while contacting the respective support, only in said direction and at least approximately to the speed of said entraining means, before the accelerated sheet on its support is actually engaged by the oncoming entraining means.

2. The combination of claim 1, wherein said moving means includes means for moving said devices toward and away from the respective supports so that each of said devices has a component of movement in said direction while in close proximity of the respective support.

3. The combination of claim 1, wherein said moving means includes means for orbiting said devices toward and away from the respective supports so that each of said devices has a component of movement in said direction while in close proximity of the respective support.

4. The combination of claim 1, wherein said moving means comprises means for orbiting said devices toward and away from the respective supports so that each of said devices has a component of movement in said direction while in close proximity of the respective support, said orbiting means including means for moving said devices along circular paths and said supports including platforms having sheet-supporting surfaces which are at least substantially tangential to the respective circular paths.

5. The combination of claim 1, wherein at least a portion of each of said devices consists of elastomeric material.

6. The combination of claim 1, wherein said devices have sheet-contacting portions consisting of a material having a relatively high coefficient of friction.

7. The combination of claim 1, wherein at least a portion of each of said devices consists of rubber.

8. The combination of claim 1, wherein each of said supports comprises means for guiding portions of sheets thereon in said direction during movement of sheets at least with said devices.

9. The combination of claim 1, wherein each of said supports comprises means for guiding portions of sheets thereon in said direction during movement of sheets with said devices and, said guiding means including projections on said supports.

10. The combination of claim 1, further comprising means for directing streams of a gaseous fluid against the sheets on said supports.

11. The combination of claim 1, wherein each of said supports comprises guide means for the sheet which is delivered thereto and said guide means extends in said direction, and further comprising means for directing streams of a gaseous fluid against the sheets on said supports, said means for directing including nozzle means having orifice means arranged to discharge streams of gaseous fluid against the exposed sides of sheets in the proximity of the respective guide means.

12. The combination of claim 1, wherein each of said supports comprises means for guiding portions of sheets thereon in said direction at least during movement of sheets with said entraining means.

13. In a machine for gathering sheets into stacks or similar accumulations, the combination of a conveyor having a plurality of spaced-apart entraining means arranged to move in a predetermined direction and along a predetermined path; a plurality of supports adjacent to said path and disposed one after the other, as considered in said direction; transfer means for delivering sheets to said supports so that the delivered sheets extend into said path; a plurality of mobile combined advancing and hold-down devices, one for each of said supports, for urging the delivered sheets against the respective supports; means for moving said devices into engagement with the sheets on said supports and thereupon at least substantially in said direction in synchronism with movements of said entraining means so that a sheet which is about to be engaged by the oncoming entraining means is urged against the respective support by the associated device and is accelerated by such device on the respective support only in said direction at least approximately to the speed of said entraining means before the accelerated sheet on its support is actually engaged by the oncoming entraining means; means for directing streams of a gaseous fluid against the sheets on said supports; and means for regulating the admission of a gaseous fluid against the sheets on said supports in synchronism with movements of said entraining means, including means for interrupting the discharge of a stream against a sheet on the respective support while said transfer means delivers a sheet to such support.

* * * * *